United States Patent [19]

Mathews et al.

[11] Patent Number: 4,461,311

[45] Date of Patent: Jul. 24, 1984

[54] METHOD AND SMOKING ARTICLE WRAPPER FOR REDUCING SIDESTREAM SMOKE

[75] Inventors: John H. Mathews; Mary L. DeLucia, both of Lee; Charles F. Mattina, Lenox, all of Mass.

[73] Assignee: Kimberly-Clark Corporation, Neenah, Wis.

[21] Appl. No.: 334,120

[22] Filed: Dec. 24, 1981

[51] Int. Cl.[3] ..... A24D 1/02

[52] U.S. Cl. ..... 131/365; 131/358; 131/334

[58] Field of Search ..... 131/334, 365, 336, 358

[56] References Cited

U.S. PATENT DOCUMENTS

| | | | |
|---|---|---|---|
| 3,667,479 | 6/1972 | Sanford et al. | 131/365 |
| 3,744,496 | 7/1973 | McCarty et al. | 131/365 |
| 3,797,504 | 3/1974 | Hughes et al. | 131/365 |
| 3,861,401 | 1/1975 | Briskin et al. | 131/365 |
| 4,225,636 | 9/1980 | Cline et al. | 427/243 |
| 4,231,377 | 11/1980 | Cline et al. | 131/365 |

*Primary Examiner*—V. Millin

*Attorney, Agent, or Firm*—William D. Herrick; R. Jonathan Peters; Howard Olevsky

[57] ABSTRACT

Sheet material especially useful in forming wrappers for smokable articles such as cigarettes that results in reduced sidestream smoke. The sheet is formed by applying to a cellulosic web an amount of an alkali metal salt greatly in excess of the amounts of such materials previously used as burn enhancers. The cellulosic material may be flax fiber or other natural cellulosic fibers conventionally used for such wrappers. Examples of salts include the sodium or potassium salts of acids such as carbonic, formic, acetic, propionic, malic, lactic, glycolic, citric, tartaric, fumaric, oxalic, malonic, succinic, nitric, and phosphoric. The composition can be applied by any conventional method such as coating, dipping, impregnating, printing, and the like. For example, at least about 6% by weight of potassium citrate is needed to obtain the benefits of the invention, and preferably an amount in the range of from about 12% to about 16% by weight. When such papers are used as cigarette wrappers, they effect a reduction of the total particulate matter in sidestream smoke of up to about 50% without serious deterioration of other desirable properties.

20 Claims, 5 Drawing Figures

METHOD AND SMOKING ARTICLE WRAPPER FOR REDUCING SIDESTREAM SMOKE

BACKGROUND OF THE INVENTION

1. Field of the Invention

The present invention relates to wrappers for smokable articles such as cigarettes. Such articles are conventionally made by wrapping tabbacco in paper which is made from flax, or other cellulosic fibers, and calcium carbonate filler. Papers of this composition are standard in today's cigarettes. The burning cigarette releases smoke which may be classified as sidestream when it emanantes from the lit end of the cigarette or mainstream when it is drawn through the tobacco column to the smoker. The present invention is directed to an improved method and wrapper that materially reduce the quantity of the sidestream smoke.

2. Description of the Prior Art

Various attempts have been made to reduce the level of sidestream smoke. However, none has been successful to the point of significant commercial exploitation. For example, U.S. Pat. No. 4,225,636 to Cline et al issued 30 September 1980 is directed to the use of high porosity carbon coated cigarette papers disclosed to provide substantial reductions in both mainstream and sidestream smoke. U.S. Pat. No. 3,744,496 to McCarty et al issued 10 July 1973 is also directed to a carbon filled wrapper which is preferably treated with compounds such as alkali metal hydroxides, bicarbonates and carbonates. It also has been recognized that some smoking articles wrapped in tobacco leaf release lower amounts of sidestream smoke, but such wrappers are not practical for use on cigarettes. These products, as well as those resulting from other attempts at sidestream reduction, have suffered either from excessive cost or adverse effects relating to mainstream particulate deliveries, draw, taste, or other factors such as burn rate. Therefore, none of these has represented a practical solution for decreasing sidestream smoke from cigarettes.

Many of the compounds useful in accordance with the invention described herein have been known as additives to wrappers for smokable articles primarily as burn enhancers. For example, U.S. Pat. No. 4,231,377 to Cline et al issued 4 November 1980 describes a wrapper containing at least 15% by weight magnesium oxide or its hydrate plus at least 0.5% by weight of a chemical adjuvant which may include alkali metal acetates, carbonates, citrates, nitrates, or tartrates. Examples are included wherein a maximum of 3.5% of the chemical adjuvant is applied. Other references to the use of such compositions include U.S. Pat. No. 3,861,401 to Briskin et al issued 21 January 1975; U.S. Pat. No. 3,797,504 to Hughes et al issued 19 March 1974 and U.S. Pat. No. 3,667,479 to Sanford et al issued 6 June 1972, each of which describes improvements in burn properties.

Notwithstanding such descriptions, the problem of sidestream smoke remains, and the present invention provides a practical and effective cellulosic wrapper for smokable articles that reduces sidestream smoke while avoiding significant deterioration of other desirable properties.

SUMMARY OF THE INVENTION

The present invention results in a wrapper for a smokable article providing substantial reduction in sidestream smoke without significant adverse effect on properties such as mainstream particulate matter and puff count; these results are obtained by modifying conventional cigarette paper. The paper is treated with an extraordinary amount of an alkali metal salt which is far in excess of amounts previously used in connection with enhancing burn properties. Such additives include sodium or potassium salts of acids such as carbonic, formic, acetic, propionic, malic, lactic, glycolic, citric, tartaric, fumaric, oxalic, malonic, succinic, nitric, and phosphoric. An amount equal to at least about 6% by weight is required to obtain the benefits of the present invention. Previously, it was believed that amounts of such additives in excess of about 3.0% would not result in any additional benefit. Surprisingly, the application of these alkali metal salts to the paper in extraordinary amounts as described in the present invention produces very significant reductions in sidestream smoke while only minimally affecting other burn properties. Preferred embodiments include the application of potassium citrate to cigarette paper having a permeability of not more than 10 cm/min and a bulk of about at least 1.3 $cm^3/g$. As used here, bulk is defined as the superficial volume in cubic centimeters of one gram of paper, computed from the basis weight of that paper before treatment and its thickness after treatment.

DESCRIPTION OF THE PREFERRED EMBODIMENTS

Figure 1:
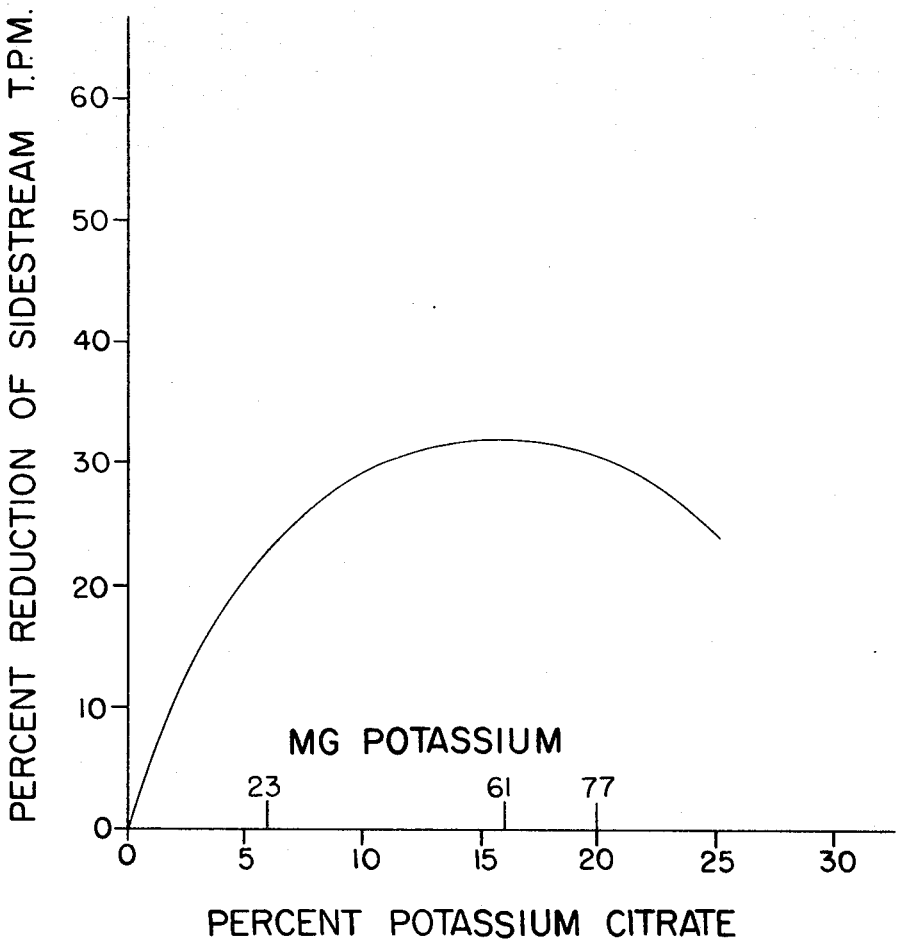
FIG. 1 is a graph illustrating, in accordance with the invention, the percent reduction of sidestream smoke as a function of the level of potassium citrate applied to the paper.

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

During the smoking of a cigarette, a large fraction of the total smoke generated by combustion of the tobacco is released from the lit end of the cigarette as sidestream smoke. The relative amounts of mainstream and sidestream in a given instance will depend upon the manner in which it is smoked. If the cigarette is placed in an ashtray for prolonged intervals between puffs, sidestream becomes a very large fraction of the total smoke produced. Whether the cigarette is held by the smoker or rests in an ashtray during the interval betwen puffs, the sidestream rises as a concentrated and highly visible plume of smoke. Moreover, this concentrated plume continues to emanate from the lit end of a cigarette even while air is being drawn in during the puff, so that sidestream smoke is constantly released in large quantities throughout the consumption of a cigarette, regardless of whether consumption is largely by smoldering or by puffing. At times, the sidestream smoke plume is carried by air currents into the vicinity of other persons who may find it a source of annoyance. Therefore, cigarettes producing markedly less sidestream are highly desirable.

In accordance with the present invention, sidestream smoke particulate matter is greatly reduced by modifications of the paper used to wrap the tobacco column. Prior attempts to reduce sidestream smoke by wrapper modifications have involved the use of papers which were technically or economically impractical, which were aesthetically unacceptable, or which resulted in drastically increased mainstream smoke delivery and puff count. In contrast, the modifications of the present invention do not result in retarded burn rate or elevated delivery of mainstream tar; they do not adversely affect the appearance of the cigarette or ash; and they do not require the use of exotic materials or manufacturing processes. For example, cigarettes made with the wrapper of the present invention afford normal enjoyment to the smoker but diminish the possibility of stray smoke being objectionable to bystanders.

In accordance with the invention, these highly desirable beneficial effects are obtained by treating wrapper materials for smokable articles with extraordinary amounts of alkali metal salts. Such wrapper materials are conventional cigarette papers made from flax and/or other cellulosic fibers containing an inorganic filler, typically calcium carbonate. Other suitable mineral fillers will be apparent to those skilled in this art. These fillers are useful over a broad range of from about 10% to about 50% by weight in accordance with this invention.

While the use of such salts has been established for many years as additives to cigarette papers for the purposes of improving ash characteristics and accelerating burn rate, in conventional use they are added in small amounts ranging from about 1% to 3% of the weight of the base paper. In accordance with the present invention such alkali metal salts, normally burn accelerators, are added to the wrapper at levels far beyond those previously used and it has been discovered that their effect on cigarette burn rate reverses; further increments of salt addition result, instead, in decreases in burn rate. In fact, with papers of low porosity and/or relatively low levels of calcium carbonate filler, addition of excess alkali metal salts, for example, above about 20% potassium citrate based on the base paper weight, usually results in loss of burn continuity; cigarettes made with such papers are self-extinguishing.

Figure 2:
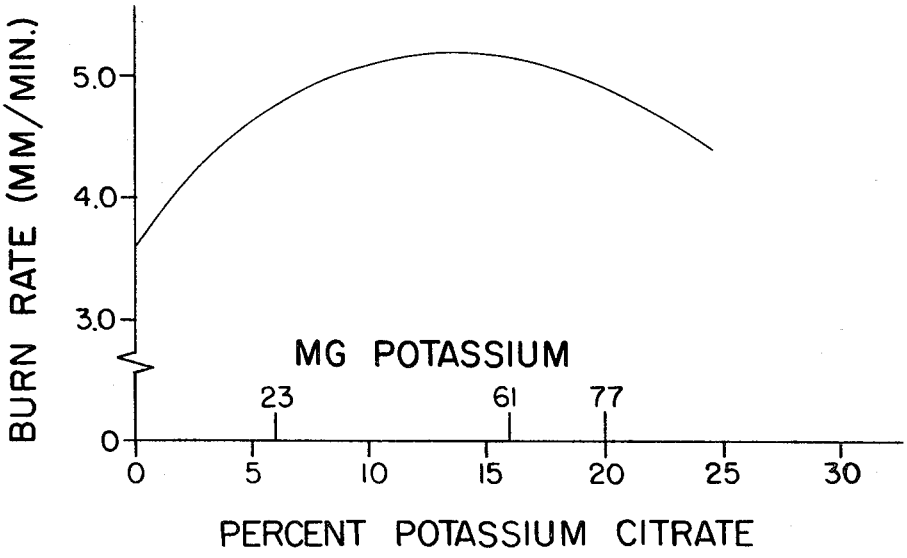
FIG. 2 illustrates, in accordance with the invention, the corresponding effect upon burn rate of this application of potassium citrate to the paper.

More importantly, it has been discovered that, whether mechanistically related or merely coincident phenomena, when the level of alkali metal salts present is in the range of concentration where the inversion of burn rate occurs, then the amount of sidestream particulate smoke is substantially reduced. The effects of sidestream total particulate delivery (SS-TPM) and burn rate from adding increasing amounts of potassium citrate to a standard, widely used, cigarette paper are shown in FIGS. 1 and 2. For these examples, a cigarette paper having basis weight of 25 $g/m^2$ permeability of 25 cm/min (CORESTA), bulk of 1.47 $cm^3/g$ and containing 30% calcium carbonate as filler was used. Such cigarette paper is readily available commercially. As shown, the shift of burn rate acceleration in response to increasing salt addition takes place gradually over the range between about 6% potassium citrate and about 16%. At the same time, the reduction of sidestream smoke, which is about 25% with 6% salt addition, rises to about 35% at 16% salt, and it begins to decline at about the 20% level of addition. These levels of potassium citrate correspond to a range of from about 23 to about 77 milligrams of alkali metal per gram of base paper.

Broadly, such salts are effective in a range of above about 23 milligrams of alkali metal, however, the preferred range is at least about 46 milligrams of alkali metal per gram of base web. For most purposes amounts in excess of about 100 milligrams of alkali metal per gram of base paper will be uneconomic.

Figure 3:
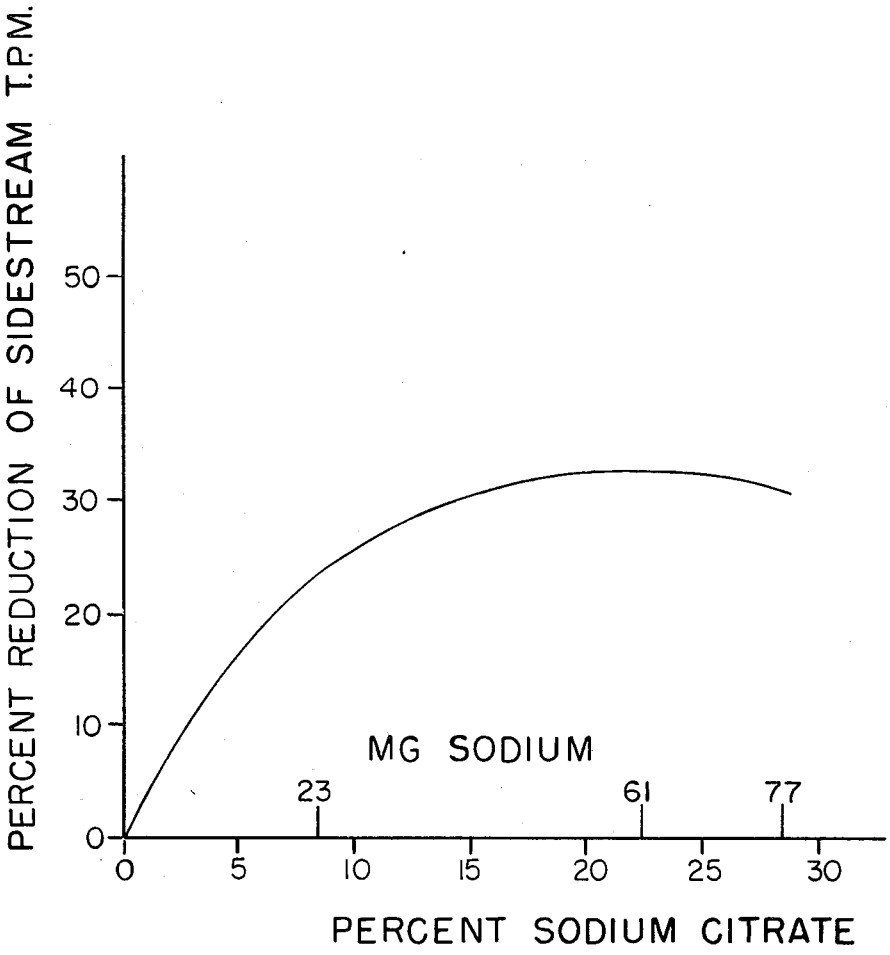
FIGS. 3 and 4 correspond to FIGS. 1 and 2 but using sodium citrate.
Figure 4:
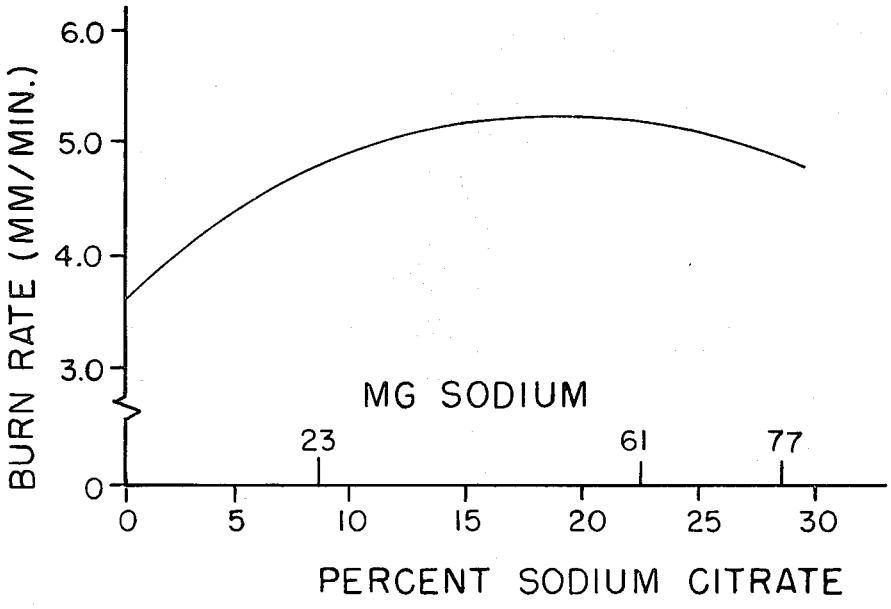

While the examples are illustrated using potassium citrate, other compounds giving equivalent effects include alkali metal salts of the following acids: carbonic, formic, acetic, propionic, malic, lactic, glycolic, tartaric, fumaric, oxalic, malonic, succinic, nitric, and phosphoric. It will be recognized by those skilled in the art that the shapes of the curves of FIGS. 1 and 2 will vary somewhat with different salts as illustrated by FIGS. 3 and 4 for sodium citrate. However, the curves are characteristic and the described effects on sidestream reduction and burn rate occurs in each case at percentage additions above about 6% by weight. It has also been found that other alkali metal salts such as sodium salts are effective. It will also be recognized that such salts can be used in combination. If other salts are used, the amounts added to the paper are adjusted to provide the same quantity of alkali metal as would be provided by the required amount of potassium citrate.

Figure 5:
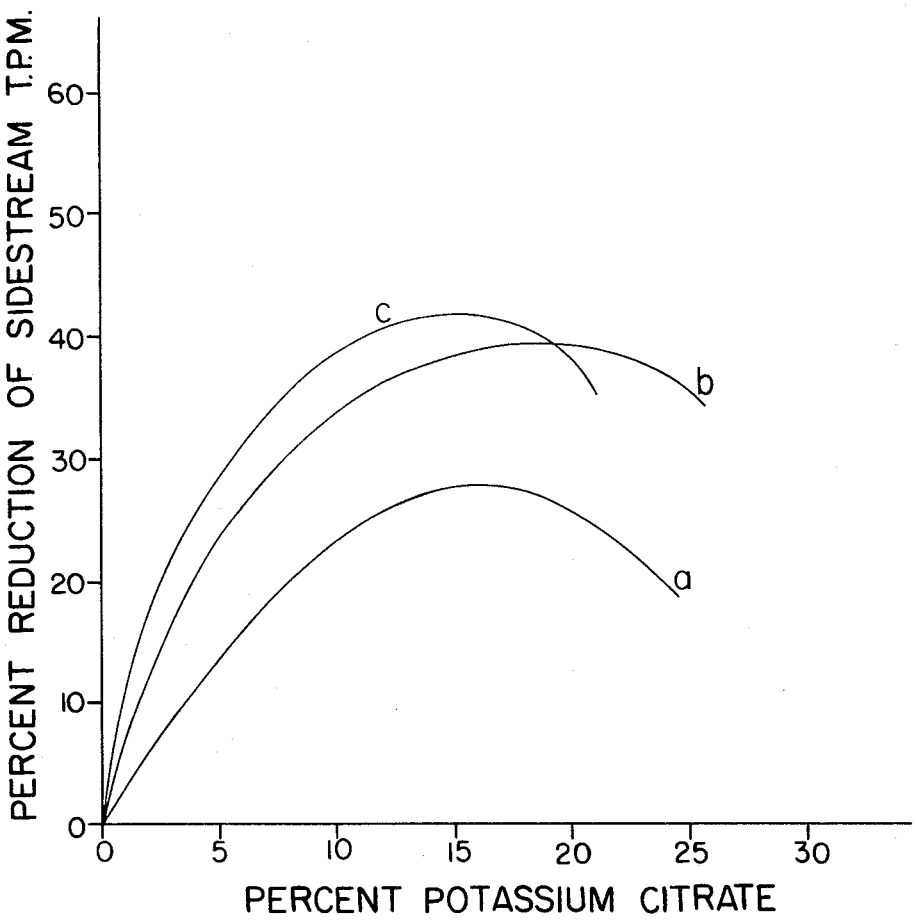
FIG. 5 is a graph showing the enhancement of the effect of the potassium citrate through decreases in the porosity of the paper.

Treating any conventional cigarette paper with extraordinary amounts of alkali metal salts as described in this disclosure, results in a decrease in the level of sidestream smoke. However, the effect of this treatment can be maximized by using paper with low porosity and by maintaining sheet bulk at a high level consistent with low porosity. Thus, FIG. 5 illustrates the improvement resulting from the use of lowered porosity in decreasing sidestream smoke at a given level of chemical treatment. Curves A, B and C were obtained using papers with different porosities, respectively 25, 6 and 1 cm/min. As shown, for a given level of chemical treatement, lower porosity causes further decreases in sidestream smoke. The porosities are expressed as CORESTA permeability (superficial velocity, in centimeters per minute, of air flowing through a porous paper at a pressure differential of one centibar). FIG. 5 demonstrates that porosity below about 10 cm/min is preferred for sidestream reduction.

EXAMPLES

The following examples demonstrate the present invention and were carried out using the flax cigarette paper described in Tables 1 and 2. Potassium citrate was applied by saturating this cigarette paper in a generally uniform manner, with an aqueous solution of that salt. Unfiltered cigarettes, 70 millimeters in length and 25 millimeters in circumference, were made with the treated papers and a Standard American Blend of tobacco.

The Federal Trade Commission method for determining total particulate matter (TPM) was used for the analyses of mainstream smoke. The sidestream smoke during the static burn of 40 millimeters of each cigarette's length was collected on a Cambridge Filter Pad; the amounts collected are expressed as sidestream total particulate matter (SS-TPM).

Table 1 describes Examples 1 through 7 and shows the effect of sheet bulk on sidestream reduction both with and without the chemical treatment of three different papers. The bulk of a sheet is normally computed from the basis weight of the paper and its thickness, measured by TAPPI Method T-411; however, as used herein, the bulk values were computed using the weight of the base paper (excluding the weight of chemical added) and the thickness of the final product after chemical addition. The paper with the lowest bulk is clearly inferior, even though its low porosity would be expected to improve sidestream reduction. The significance of bulk is further demonstrated by comparing Examples 5 and 6 which show that, in spite of its increased thickness, higher weight, and lower permeability, the material of Example 5 delivers more sidestream particulate matter than the material of Example 6.

TABLE 1

| Examples | 1 | 2 | 3 | 4 | 5 | 6 | 7 |
|---|---|---|---|---|---|---|---|
| Percent Potassium Citrate | 0 | 0 | 0 | 15.3 | 15.3 | 15.3 | 15.5 |
| Permeability, cm/min | 9 | 3 | 6 | 9 | 3 | 6 | 3 |
| Basis Weight, $g/m^2$ of Base Paper | 36 | 36 | 25 | 36 | 36 | 25 | 33 |
| Thickness, Microns | 53 | 35 | 36 | 56 | 39 | 36 | 45 |
| Bulk, $cm^3/g$ | 1.49 | 0.99 | 1.45 | 1.55 | 1.09 | 1.44 | 1.37 |
| Calcium Carbonate, % | 33 | 33 | 23 | 33 | 33 | 23 | 15 |
| SS-TPM mg/Cigarette | 24 | 27 | 24 | 12.7 | 16.1 | 15.5 | 11.3 |
| Burn Time, Min/40 mm | 11.2 | 11.8 | 13.5 | 8.4 | 10.2 | 9.2 | 12.8 |

Table 2 describes Examples 8 through 15 and compares the deliveries of mainstream smoke dry particulate matter (DPM=TPM−water) and the puff counts of several standard cigarette papers with the DPM deliveries and puff counts of the same papers after applying the treatment of the present invention. As shown, the present invention reduces sidestream smoke without increasing mainstream tar and nicotine.

TABLE 2

| Examples | 8 | 9 | 10 | 11 | 12 | 13 | 14 | 15 |
|---|---|---|---|---|---|---|---|---|
| PAPER PROPERTIES | | | | | | | | |
| Permeability, cm/min | 6 | 6 | 25 | 25 | 60 | 60 | 6 | 6 |
| Basis Weight, $g/m^2$ of Base Paper | 25 | 25 | 25 | 25 | 25 | 25 | 36 | 36 |
| Thickness, Microns | 35.8 | 36.0 | 36.8 | 40.0 | 40.3 | 42.6 | 53.8 | 56 |
| Bulk, $cm^3/g$ | 1.45 | 1.44 | 1.47 | 1.60 | 1.61 | 1.70 | 1.49 | 1.51 |
| Calcium Carbonate, % | 23 | 23 | 30 | 30 | 35 | 35 | 33 | 33 |
| Chemical: | | | | | | | | |
| % Potassium Citrate | 1.0 | 15.3 | 1.0 | 15.3 | 1.0 | 15.3 | — | — |
| % Potassium carbonate | — | — | — | — | — | — | 0.68 | 10.4 |
| Milligrams of Alkali Metal Per Gram of Base Paper | 3.8 | 58.1 | 3.8 | 58.1 | 3.8 | 58.1 | 3.8 | 58.1 |
| MAINSTREAM | | | | | | | | |
| Puff Count | 9.2 | 7.3 | 8.7 | 6.9 | 8.3 | 7.6 | — | — |
| DPM, mg/Cigarette | 29.7 | 26.9 | 24.0 | 19.8 | 18.9 | 18.0 | — | — |
| SIDESTREAM | | | | | | | | |
| Burn Rate, mm/min | 3.3 | 4.4 | 3.8 | 5.2 | 4.3 | 5.3 | 4.0 | 4.4 |
| SS-TPM, mg/cigarette | 22.0 | 15.5 | 22.5 | 17.5 | 23.0 | 17.5 | 24.0 | 12.6 |

Thus it is apparent that there has been provided, in accordance with the invention, a sheet material adapted for use as a wrapper for smoking articles that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. In a material adapted for use as a wrapper for smoking articles comprising a cellulosic base web containing about 10% to about 50% by weight of an inorganic filler, the improvement wherein said material contains an alkali metal salt equivalent to at least about 23 milligrams of alkali metal per gram of base web.

2. The material of claim 1 wherein the salt is selected from the group consisting of sodium and potassium salts of carbonic acid, formic acid, acetic acid, propionic acid, malic acid, lactic acid, glycolic acid, citric acid, tartaric acid, fumaric acid, oxalic acid, malonic acid, nitric acid, and phosphoric acid.

3. The material of claim 2 wherein the salt is selected from the group consisting of sodium citrate and potassium citrate.

4. The material of claim 3 wherein the base comprises flax fibers.

5. The material of claim 4 wherein the inorganic filler is calcium carbonate.

6. The material of claim 3 wherein the alkali metal salt is contained in an amount equivalent to at least about 46 milligrams of alkali metal per gram of base web.

7. The material of claim 6 wherein the alkali metal salt is contained in an amount of about 61 milligrams of alkali metal per gram of base web.

8. The material of claim 1 wherein the base web has a permeability of up to about 10 cm/min.

9. The material of claim 1 wherein said base web has a bulk of at least about 1.3 $cm^3$/gram.

10. In a material adapted for use as a wrapper for smoking articles comprising a flax base web containing about 10% to about 50% by weight of calcium carbonate filler and having a porosity of up to about 10 cm/min and bulk of at least about 1.3 $cm^3$/gram, the improvement wherein said material contains a sodium or potassium metal salt equivalent to alkali metal in an amount of at least about 46 milligrams of alkali metal per gram of base web.

11. In a method of forming a material adapted for use as a wrapper for smoking articles by treatment of a cellulosic base web containing about 10% to about 50% by weight of an inorganic filler, the improvement wherein said treatment adds to said base web an alkali metal salt amount equivalent to at least about 23 milligrams of alkali metal per gram of base web.

12. The method of claim 11 wherein the salt is selected from the group consisting of sodium and potassium salts of carbonic acid, formic acid, acetic acid, propionic acid, malic acid, lactic acid, glycolic acid, citric acid, tartaric acid, fumaric acid, oxalic acid, malonic acid, nitric acid, and phosphoric acid.

13. The method of claim 12 wherein the salt is selected from the group consisting of sodium citrate and potassium citrate.

14. The method of claim 13 wherein the base web comprises flax fibers.

15. The method of claim 14 wherein the inorganic filler is calcium carbonate.

16. The method of claim 13 wherein the alkali metal salt is contained in the resulting material in an amount equivalent to at least about 46 milligrams of alkali metal per gram of base web.

17. The method of claim 16 wherein the alkali metal salt is contained in am amount of about 61 milligrams of alkali metal per gram of base web.

18. The method of claim 11 wherein the base web has a permeability of up to about 10 cm/min.

19. The method of claim 11 wherein the base web has a bulk of at least about 1.3 $cm^3$/gram.

20. In a method of forming a material adapted for use as a wrapper for smoking articles by treatment of a flax base web containing about 10% to about 50% by weight of calcium carbonate filler and having a porosity of up to about 10 cm/min and bulk of at least about 1.3 $cm^3$/gram, the improvement wherein said treatment adds to said base web a sodium or potassium metal salt in an amount equivalent to at least about 46 milligrams of alkali metal per gram of base web.

* * * * *

REEXAMINATION CERTIFICATE (1499th)

United States Patent [19]

Mathews et al.

[11] B1 4,461,311

[45] Certificate Issued Jul. 2, 1991

[54] METHOD AND SMOKING ARTICLE WRAPPER FOR REDUCING SIDESTREAM SMOKE

[75] Inventors: John H. Mathews; Mary L. DeLucia, both of Lee; Charles F. Mattina, Lenox, all of Mass.

[73] Assignee: Kimberly-Clark Corporation, Neenah, Wis.

Reexamination Request:
No. 90/001,917, Dec. 28, 1989

Reexamination Certificate for:

| | |
|---|---|
| Patent No.: | **4,461,311** |
| Issued: | **Jul. 24, 1984** |
| Appl. No.: | **334,120** |
| Filed: | **Dec. 24, 1981** |

[51] Int. Cl.[5] ..... A24D 1/02

[52] U.S. Cl. ..... 131/365; 131/358; 131/334

[58] Field of Search ..... 131/336, 334, 358, 365

[56] References Cited

U.S. PATENT DOCUMENTS

| | | |
|---|---|---|
| 2,693,415 | 11/1954 | Schur . |
| 3,030,963 | 4/1962 | Cohn . |
| 3,220,418 | 11/1965 | Cohn . |
| 3,722,515 | 3/1973 | Reynolds et al. . |
| 4,044,778 | 8/1977 | Cohn . |
| 4,187,862 | 2/1980 | Cohn . |

FOREIGN PATENT DOCUMENTS

| | | |
|---|---|---|
| 145863 | 1/1981 | German Democratic Rep. . |
| 249932 | 12/1969 | U.S.S.R. . |
| 249933 | 12/1969 | U.S.S.R. . |

OTHER PUBLICATIONS

The Effect of Electrolyte On the Special Properties of Cigarette Paper, N. V. Timolovskaya, T. P. Volkova, G. A. Vlasova, Bumazhnaya Promyshlennost', [Paper Industry], No. 12, Dec. 1970.

Inhibitory Effect of Oxygenated Salts on the Formation of 3,4-Benzopyrene During Combustion of Cigarette Paper, Hubert-Habart et al, Academie Des Sciences, pp. 1440 and 1441, Mar. 3, 1958.

Factors Affecting Static Burning Rate, F. E. Resnik, W. G. Houck, W. A. Geiszler, & J. E. Wickham, Tobacco Science, XXI: pp. 103-107, 1977.

*Primary Examiner*—V. Millin

[57] ABSTRACT

Sheet material especially useful in forming wrappers for smokable articles such as cigarettes that results in reduced sidestream smoke. The sheet is formed by applying to a cellulosic web an amount of an alkali metal salt greatly in excess of the amounts of such materials previously used as burn enhancers. The cellulosic material may be flax fiber or other natural cellulosic fibers conventionally used for such wrappers. Examples of salts include the sodium or potassium salts of acids such as carbonic, formic, acetic, propionic, malic, lactic, glycolic, citric, tartaric, fumaric, oxalic, malonic, succinic, nitric, and phosphoric. The composition can be applied by any conventional method such as coating, dipping, impregnating, printing, and the like. For example, at least about 6% by weight of potassium citrate is needed to obtain the benefits of the invention, and preferably an amount in the range of from about 12% to about 16% by weight. When such papers are used as cigarette wrappers, they effect a reduction of the total particulate matter in sidestream smoke of up to about 50% without serious deterioration of other desirable properties.

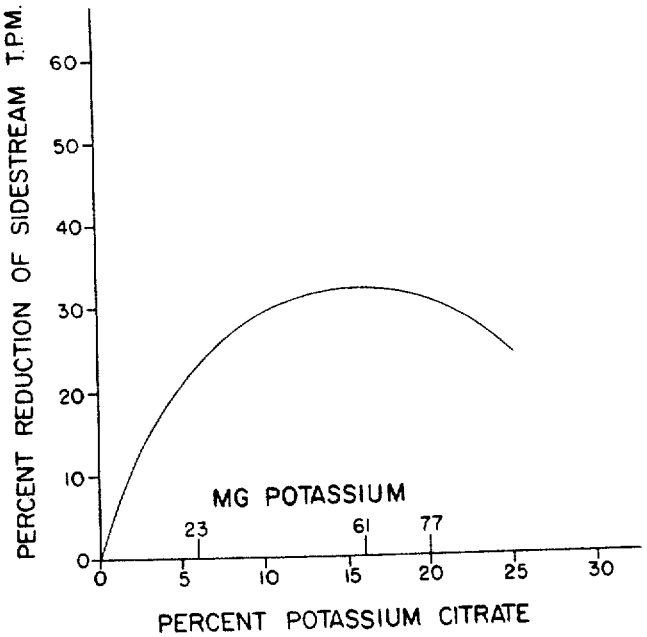

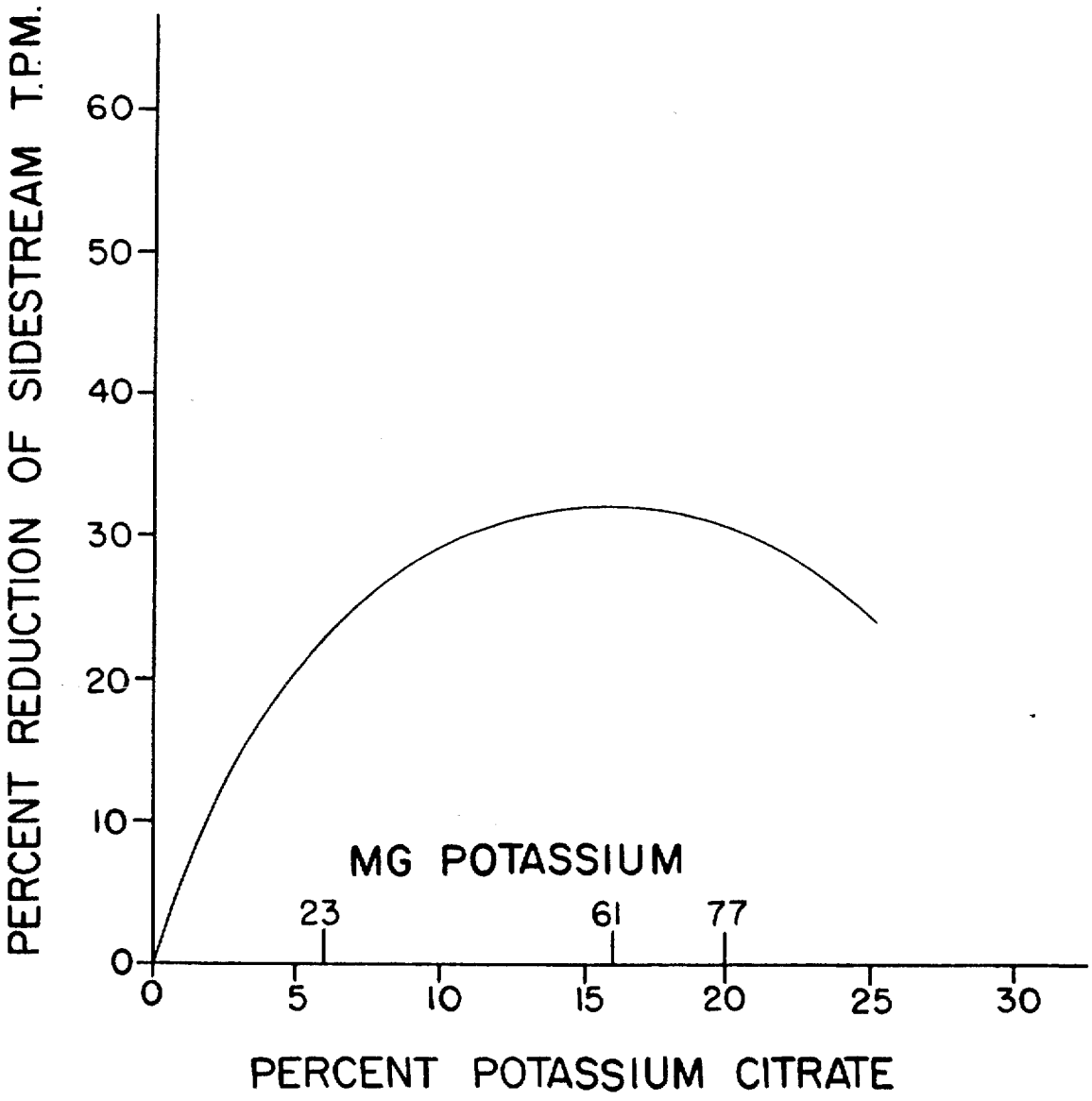
PERCENT REDUCTION OF SIDESTREAM T.P.M.
60
50
40
30
20
10
0
MG POTASSIUM
23
61
77
0
5
10
15
20
25
30
PERCENT POTASSIUM CITRATE

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 10, 11, 20 are determined to be patentable as amended.

Claims 2-9, 12-19, dependent on an amended claim, are determined to be patentable.

New claims 21, 22 are added and determined to be patentable.

1. In a material adapted for use as a wrapper for smoking articles comprising a celllulosic base web containing about 10% to about 50% by weight of an inorganic filler, the improvement wherein said material contains an alkali metal salt equivalent to at least about 23 milligrams of alkali metal per gram of base web, *and wherein the sidestream smoke emitted by said smoking article is reduced substantially.*

10. In a material adapted for use as a wrapper for smoking articles comprising a flax base web containing about 10% to about 50% by weight of calcium carbonate filler and having a porosity of up to about 10 cm/min and bulk of at least about 1.3 $cm^3$/gram, the improvement wherein said material contains a sodium or potassium metal salt equivalent to alkali metal in an amount of at least about 46 milligrams of alkali metal per gram of base web, *and wherein the sidestream smoke emitted by said smoking article is reduced substantially.*

11. In a method of forming a material adapted for use as a wrapper for smoking articles by treatment of a cellulosic base web containing about 10% to about 50% by weight of an inorganic filler, the improvement wherein said treatment adds to said base web an alkali metal salt amount equivalent to at least about 23 milligrams of alkali metal per gram of base web, *and wherein the sidestream smoke emitted by said smoking article is reduced substantially.*

20. In a method of forming a material adapted for use as a wrapper for smoking articles by treatment of *comprising* a flax base web containing about 10% to about 50% by weight of calcium carbonate filler and having a porosity of up to about 10 cm/min and bulk of at least about 1.3 $cm^3$/gram, the improvement wherein said treatment adds to said base web a sodium or potassium metal salt in an amount equivalent to *alkali metal in an amount of* at least about 46 milligrams of alkali metal per gram of base web, *and wherein the sidestream smoke emitted by said smoking article is reduced substantially.*

*21. In a material adapted for use as a wrapper for smoking articles comprising a cellulosic base web containing about 10% to about 50% by weight of an inorganic filler and having a bulk of at least about 1.3 $cm^1$/gram,*

*the improvement wherein said material contains an alkali metal salt equivalent to at least about 23 milligrams of alkali metal per gram of base web; said alkali metal salt being selected from the group consisting of sodium and potassium salts of carbonic acid, formic acid, acetic acid, propionic acid, malic acid, lactic acid, glycolic acid, citric acid tartaric acid, fumaric acid, oxalic acid, malonic acid, nitric acid, succinic acid, and phosphoric acid, and wherein the sidestream smoke emitted by said smoking article is reduced substantially.*

*22. In a method of forming a material adapted for use as a wrapper for smoking articles by treatment of a cellulosic base web containing about 10% to about 50% by weight of an inorganic filler and having a bulk of at least about 1.3 $cm^3$/gram,*

*the improvement wherein said treatment adds to said base web an alkali metal salt equivalent to at least about 23 milligrams of alkali metal per gram of base web; said alkali metal salt being selected from the group consisting of sodium and potassium salts of carbonic acid, formic acid, acetic acid, propionic acid, malic acid, lactic acid, glycolic acid, citric acid tartaric acid, fumaric acid, oxalic acid, malonic acid, nitric acid, succinic acid, and phosphoric acid, and wherein the sidestream smoke emitted by said smoking article is reduced substantially.*

* * * * *